US006472801B1

(12) United States Patent
Matsubara et al.

(10) Patent No.: US 6,472,801 B1
(45) Date of Patent: Oct. 29, 2002

(54) SPARK PLUG WITH A CORROSION IMPEDING LAYER

(75) Inventors: Yoshihiro Matsubara, Yokkaichi; Shoichiro Ito, Toki; Yuji Hirano, Nagoya; Naomichi Miyashita, Nagoya; Hiroaki Kuki, Nagoya, all of (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 110 days.

(21) Appl. No.: 09/603,612

(22) Filed: Jun. 26, 2000

(30) Foreign Application Priority Data

Jun. 25, 1999 (JP) ..... 11-180426
May 31, 2000 (JP) ..... 2000-163837

(51) Int. Cl.[7] ..... H01T 13/20
(52) U.S. Cl. ..... 313/141; 313/143; 313/144
(58) Field of Search ..... 313/130, 137, 313/141, 143, 144

(56) References Cited

FOREIGN PATENT DOCUMENTS

| | | | |
|---|---|---|---|
| DE | 195 34 340 C1 | 4/1997 | ..... H01T/13/52 |
| DE | 198 28 168 A 1 | 12/1999 | ..... C04B/41/87 |
| GB | 2 338 664 A | 12/1999 | ..... C04B/41/87 |
| JP | 7-73956 | 3/1995 | |
| JP | 10-50455 | 2/1998 | |
| JP | 10-289777 | 10/1998 | |
| WO | WO 97/10632 | 3/1997 | ..... H01T/13/52 |

*Primary Examiner*—Vip Patel
(74) *Attorney, Agent, or Firm*—Morgan, Lewis & Bockius LLP

(57) ABSTRACT

In a creeping discharge type spark plug, the firing surface forming portions of a center electrode and a ground electrode are made of a metallic material containing a corrosion impeding component consisting of one or more of Fe, Cr and Cu. The spark plug is attached to an internal combustion engine. When it is operated under conditions of a predetermined high speed and high load, a corrosion impeding layer containing a corrosion impeding component is formed on the surface of the top end of an insulating member, with progression of spark discharge in spark discharge gaps. The corrosion impeding layer thus formed protects the center electrode from the attack by the creeping discharge spark. Therefore, the channeling is considerably effectively prevented or restricted.

20 Claims, 15 Drawing Sheets

SPARK PLUG WITH A CORROSION IMPEDING LAYER

BACKGROUND OF THE INVENTION

1. Field of the Invention

The present invention relates to a spark plug for an internal combustion engine.

2. Description of the Related Art

A called creeping discharge type spark plug has been known as the spark plug for an internal combustion engine, which is improved in anti-contamination property. The spark plug is designed such that a spark generated in the spark gap propagates, in a creeping discharge fashion, on and along the surface of the insulating member constantly or when a specific condition is satisfied. A called semi-creeping discharge type spark plug includes a center electrode, an insulating member disposed surrounding the center electrode, and a ground electrode having the top end of which the firing surface is opposed to the side surface of the center electrode. The top end of the insulating member is located in a space (i.e., a spark discharge gap) between the center electrode and the firing surface of the ground electrode. In a creeping discharge, spark creeps on and along the surface of the top end of the insulating member, while a gaseous discharge is performed between the firing surface of the ground electrode and the surface of the insulating member. When the spark plug is used for a long time in a state that the electrode is at low temperature of 450° C. or lower, as in a pre-delivery, a called "carbon fouling" or "wet fouling" state is set up, and the insulating member is covered with conductive contamination materials, such as carbon. As a result, the spark plug tends to improperly operate. Meanwhile, in the creeping discharge type spark plug, spark is generated creeping on the surface of the insulating member. Therefore, the contamination materials are constantly burnt out. In this respect, this type of the spark plug is improved over the gaseous discharge type spark plug in the anti-contamination property.

In the creeping discharge type spark plug, as known, spark creeping on the surface of the insulating member is frequently generated, and a called channeling phenomenon in which the surface of the insulating member is grooved is easy to occur. When the channeling progresses, the following disadvantage is likely to occur: deterioration of the heat resistance and reliability of the spark plug. The channel is easy to occur when the engine is operated at high speed or high load. With recent engine power increase, the market needs spark plugs with good durability. Accordingly, the requirements for the channeling prevention or restriction are stricter.

SUMMARY OF THE INVENTION

Accordingly, an object of the present invention is to provide a spark plug which is excellent in anti-contamination property, hard in channeling, and good in durability.

In order to solve the above-described problems, a spark plug according to a first aspect of the present invention comprises:

a center electrode;

an insulating member-disposed around said center electrode in a state that a top end of said center electrode is exposed at a top end of said insulating member;

a main metallic shell provided covering said insulating member;

a ground electrode forming spark discharge gap between the top end of said center electrode and a top end of said ground electrode, and being positioned relative to the top end of said insulating member and the top end of said center electrode so as to allow creeping discharge to be performed along the surface of the top end of said insulating member; and a corrosion impeding layer formed on the surface of the top end of said insulating member, whereby corrosion of the surface of the top face of the insulating member, caused by the creeping discharge, is restricted.

The corrosion impeding layer thus formed protects the insulating member from the attack by the creeping discharge spark. And it significantly effectively prevents or restricts the channeling.

The corrosion impeding layer can be previously formed on the surface of the top end portion of the insulating member prior to using the spark plug. Alternatively, the center electrode and/or the ground electrode is constituted to contain the forming component of the corrosion impeding layer, so that the corrosion impeding layer containing the forming components of the electrodes is naturally formed on the surface of the top end portion of the insulating member with progression of spark discharge in the spark discharge gaps. Needless to say, it is possible to use both methods together. Particularly, in the latter method, even if the corrosion impeding layer is gradually wasted by spark attack, a new corrosion impeding layer can be formed accompanying with continuous using of the spark plug, while the electrodes is used as the component supplying source. Accordingly, the latter method is excellent for maintaining the effect.

The corrosion impeding layer can be constituted to contain at least one of Fe, Cr and Cu as an insulating member corrosion impeding component. Accordingly, it is possible to further enhance the effects for protecting the insulating member from attack of the creeping discharge spark and for preventing or restricting channeling.

PREFERRED EMBODIMENTS OF THE INVENTION

Some specific embodiments of the present invention will be described with reference to the accompanying drawings.

Figure 1:
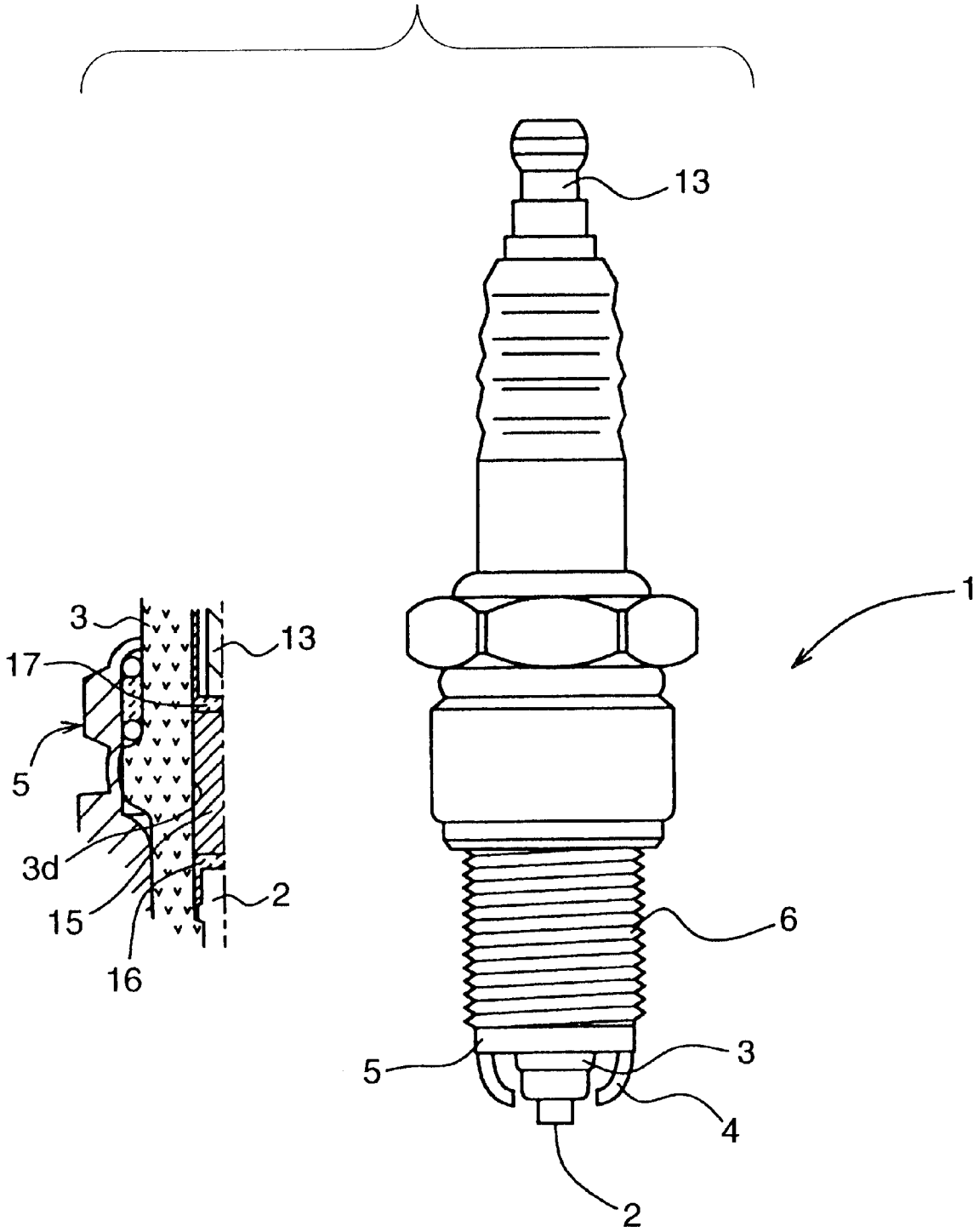
FIG. 1 is a diagram showing an overall structure of a spark plug which is an embodiment of the present invention.
Figure 2:
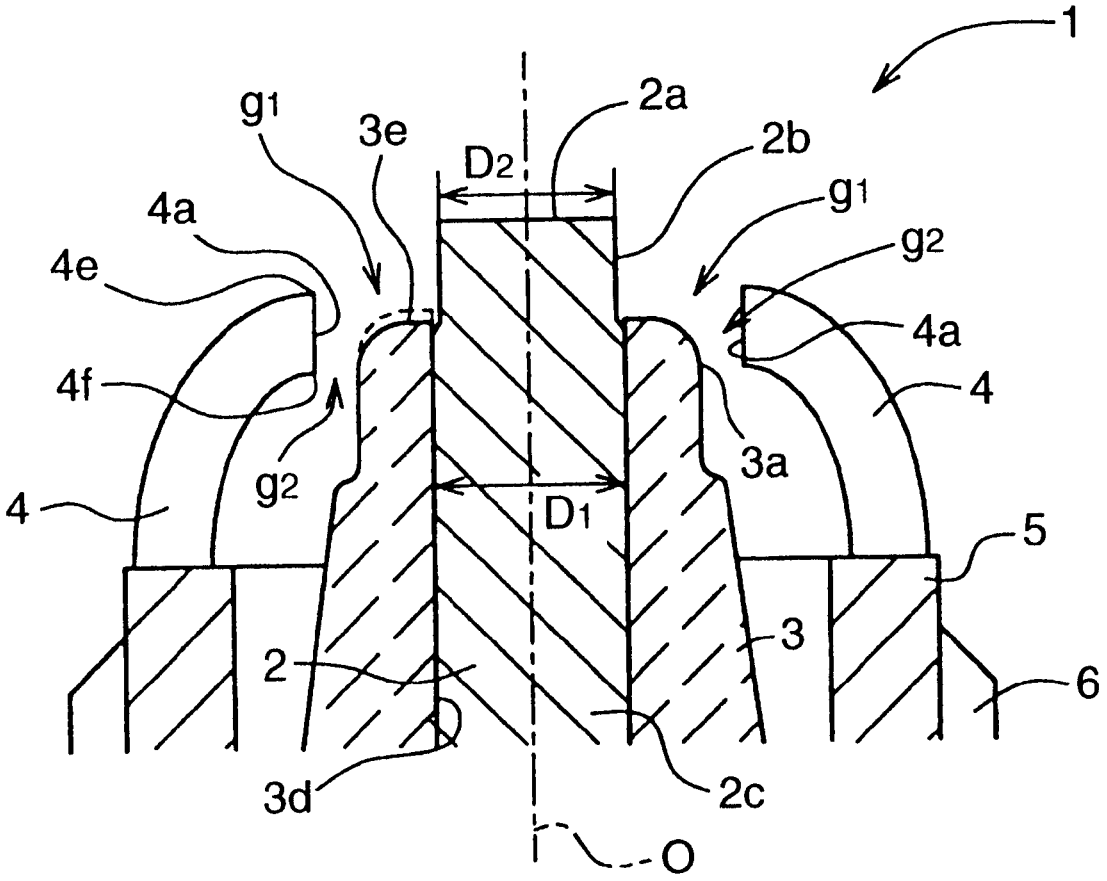
FIG. 2 is a longitudinal sectional view showing a major portion of the spark plug.

A spark plug 1, which is shown in FIG. 1 and one specific embodiment of the present invention, is a called semi-creeping discharge type spark plug. The spark plug 1 is formed with a cylindrical main metallic shell 5 made of metal, an insulating member 3, which is fit to a main metallic shell 5 in a state that its tops are projected outward, a center electrode 2 provided within the insulating member 3, ground electrodes 4 disposed such that their base ends are coupled to the main metallic shell 5 and the top end surfaces of the ground electrodes 4 oppose to the side surface of the center electrode 2 while they sandwiches the top end portion of the insulating member 3, and the like. The insulating member 3 is made of ceramic sintering material, such as alumina or aluminum nitride. As shown in FIG. 2, the insulating member has a hole (through hole) 3*d* which extends in the axial direction of the insulating member per se, and into which the center electrode 2 is fit. The main metallic shell 5 is shaped like a cylinder and made of metallic material, such as low-carbon steel. The main metallic shell forms a housing of the spark plug 1, and a threaded portion 6 used for attaching a cylinder head (not shown) is formed on the outer circumferential surface of the main metallic shell. As shown in FIG. 2, a total of two ground electrodes 4 are provided on both sides of the center electrodes 2. One end of the ground electrodes 4 is bent so that the end surfaces (referred to as firing surfaces) 4*a* thereof opposes to the side surface 2*b* (firing surface) of the top end 2*a* of the center electrode 2 while being parallel to the latter, while the other end is fixed to the main metallic shell 5 by welding or the like.

The insulating member 3 is disposed so that its top end 3*a* is located between the firing surfaces 4*a* of the side surface 2*b* and the ground electrodes 4. Assuming that in FIG. 2, a side of the spark plug which contains the top end surface of the center electrode 2 in the axial direction of the center electrode 2 is the front side, and the end opposite to the former is the rear side, the top end surface 3*e* of the insulating member 3 is located on the front side of the rear-side edges 4*f* of the end surfaces 4*a* of the ground electrodes 4. The top end surface 2*a* of the center electrode 2 is protruded beyond the top end surface 3*e* of the insulating member 3 by a predetermined distance.

Returning to FIG. 1, a terminal member 13 made of metal is inserted into one end of the through hole 3*d* of the insulating member 3, and fixed thereto. The center electrode 2 is inserted into the other end of the through hole 3*d* and fixed thereto. A resistor member 15 is disposed between the terminal member 13 and the center electrode 2 within the through hole 3*d*. Both ends of the resistor member 15, respectively, are electrically connected to the center electrode 2 and the terminal member 13 in a state that the conductive glass seal layers 16 and 17 are inserted therebetween. The terminal member 13 is made of low-carbon steel or the like, and the surface thereof is coated with a Ni plating layer (its thickness is 5 $\mu$m, for example) for preventing it from be corroded. The resistor member 15 is formed in a manner that predetermined amounts of glass powder, ceramic powder, metallic powder (containing one or more of group consisting of Zn, Sb, Sn, Ag and Ni as a main body), nonmetallic conductive powder (e.g., amorphous carbon or graphite), organic binder and the like are compounded and sintered by known process, such as hot press.

The firing surfaces of the center electrode 2 and ground electrodes 4, which face spark discharge gaps, are made of a metallic material containing a component, which consists of at least one of Fe, Cr and Cu, as an insulating-member corrosion impeding component. Specific materials of them will be described later. A core material of good thermal conduction of Cu (or its alloy) may be buried in each of the center electrode 2 and the ground electrodes 4, if necessary, in order to improve the heat introduction.

An operation of the spark plug 1 will be described.

Figure 4A:
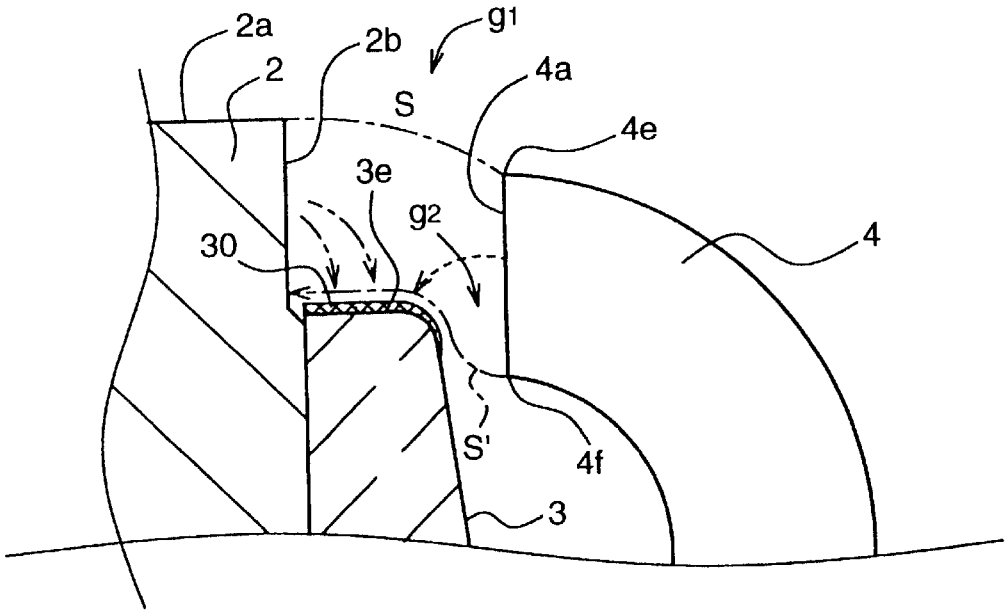
FIGS. 4A and 4B are diagrams for explaining operations of the spark plug of FIG. 1.

The spark plug 1 is mounted onto an internal combustion engine, such as a gasoline engine by the threaded portion 6 (FIG. 1) of the spark plug. In this state, it is used as a firing source to ignite an air/fuel mixture supplied to the combustion chamber. High tension voltage is applied to the spark plug 1 in such a way that its negative polarity is coupled to the center electrode 2 and its positive polarity is coupled to the ground electrodes 4. As result, as shown in FIG. 4A, a spark S is generated between the end surface 4*a* of each ground electrode 4 and the side surface 2*b* (firing surface) of the top end surface 2*a* of the center electrode 2, to thereby ignite an air/fuel mixture. The top end 3*a* of the insulating member 3 is located between the end surfaces 4*a* and the side surface 2*b* of he center electrode 2. A spark S' propagates the surface of the top end 3*a* of the insulating member 3. That is, the spark plug under discussion functions as a semi-creeping discharge type spark plug.

Figure 4B:
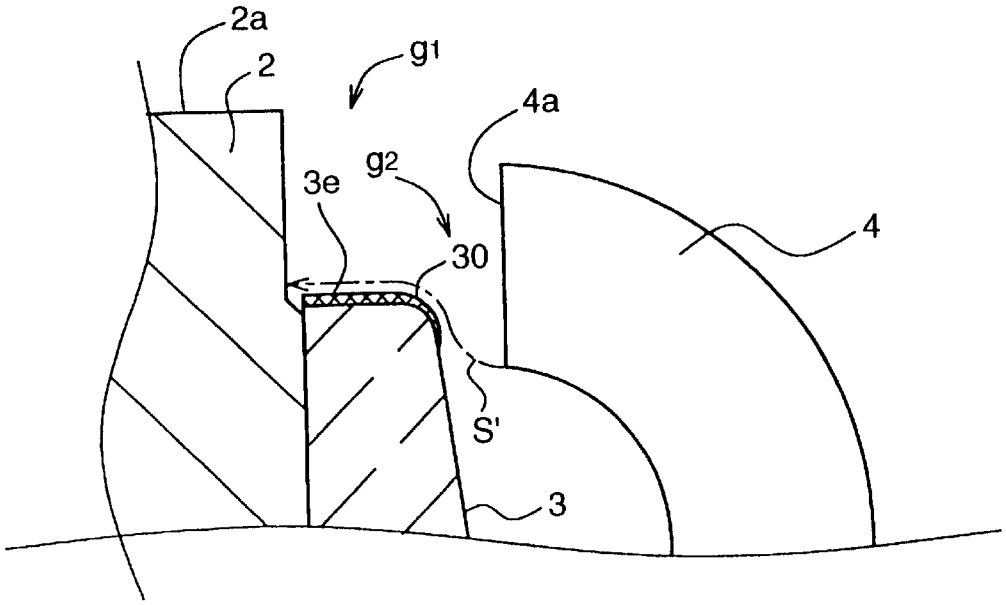

As shown in FIG. 2, in the spark plug 1 of the embodiment, the top end of the center electrode 2 is protruded above the top end of the insulating member 3. Accordingly, a first gap g1 is formed between the outer circumferential surface of the protruded part of the center electrode and the end surfaces 4*a* of the ground electrodes 4, and a second gap g2 is formed between the outer circumferential surface of the insulating member 3 and the end surfaces 4*a* of the ground electrodes. With provision of the gaps, in a stage where its contamination has less progressed, a frequency of spark occurrence in the first gap g1 is high. In a stage where its contamination has much progressed, a frequency of spark occurrence in the second gap g2 is high. It may be considered that it has such a contamination detect/cleaning function as to automatically detect the progression of contamination on the surface of the insulating member 3 and to burn off the contamination In the spark plug 1 of the embodiment, at least the firing surface portions (2*b*, 4*a*) of the center electrode 2 and the ground electrodes 4 contain one or more number of Fe, Cr and Cu as an insulating-member corrosion impeding component. When the thus constructed spark plug is attached to the internal combustion engine, and in this state the engine is operated at a high speed which is higher than a predetermined speed, or under high load conditions, a corrosion impeding layer 30, which contains the insulating-member corrosion impeding component, is formed on the surface of the top end 3*a* of the insulating member 3, with progression of the spark discharge, as shown in FIG. 4A. As a result, as shown in FIG. 4B, also in the creeping discharge performed in the second gap g2, the surface of the insulating member 3 is protected by the corrosion impeding layer 30, so that the channeling is effectively prevented or restricted.

The corrosion impeding layer 30 to be formed may be made mainly of an oxide group semiconducting compound containing at least one of Fe, Cr and Cu, as a cation component. By forming the corrosion impeding layer 30 made mainly of the oxide group semiconducting compound containing any of the elements, Fe, Cr and Cu, the channeling restricting effect is further remarkable.

The inventors presumed the reason why the above-mentioned corrosion impeding layer 30 is formed, in the following way. Spark discharge S or S' occur to ionize gas molecules in the vicinity of the spark gaps g1 and g2, and an electric gradient between the spark gaps g1 and g2 causes the generated ions to impinge upon the firing surfaces, and hence to sputter the metal component of the firing surfaces. The inside of the combustion chamber in which the spark discharge gaps g1 and g2 are located is usually high temperature oxidative atmosphere since the combustion gas is present. Therefore, the sputtered metal component immediately becomes oxide and it is deposited on the surface of the insulating member 3 to form a corrosion impeding layer 30. This may be considered to be a mechanism resembling the reactive sputtering in which the metallic material forming the firing surfaces is used as a target. In the embodiment, the center electrode is electrically negative. Therefore, it may be considered that when positive ions are generated, the firing surfaces of the center electrode 2 serve mainly as component generation sources for the corrosion impeding layer 30. In high speed or high load condition where the electrodes 2 and 4 are high in temperature, however, the metallic material of the firing surfaces (2*b*, 4*a*) will be partially molten or sputtered. The molten or sputtered metallic material will be oxidized and deposited on the surface of the insulating member. In this case, as indicated by broken lines in FIG. 4A, the firing surfaces 4*a* of the ground electrodes 4 may also function as component generation sources of the corrosion impeding layer 30.

Where Fe, Cr and Cu are contained in the metallic material of the firing surfaces 4*a* and 2*b*, whether or not the corrosion impeding layer 30 as described above is markedly formed depends on use condition of the spark plug, more specifically, temperature of the firing surfaces 4*a* and 2*b* (e.g., temperature of the top end of the center electrode or its near portion) and the like. In either case, under the condition where the temperature of the firing surfaces 4*a* and 2*b* is likely to rise, such as the high speed or high load condition, the firing surface 2*b* is easy to evaporate in sputtering fashion, so that the formation of the corrosion impeding layer 30 is facilitated. As the condition where the channeling is easy to be formed progressively matures, the formation of the corrosion impeding layer 30, which restricts the channeling, also progresses. As a result, a significantly excellent channeling restricting effect is achieved. The temperature condition of the firing surfaces under which the formation of the corrosion impeding layer 30 is facilitated may be considered to be approximately 600° C. or higher, although it is affected by the compositions of the combustion gas, an air/fuel ratio and the like.

Figure 3:
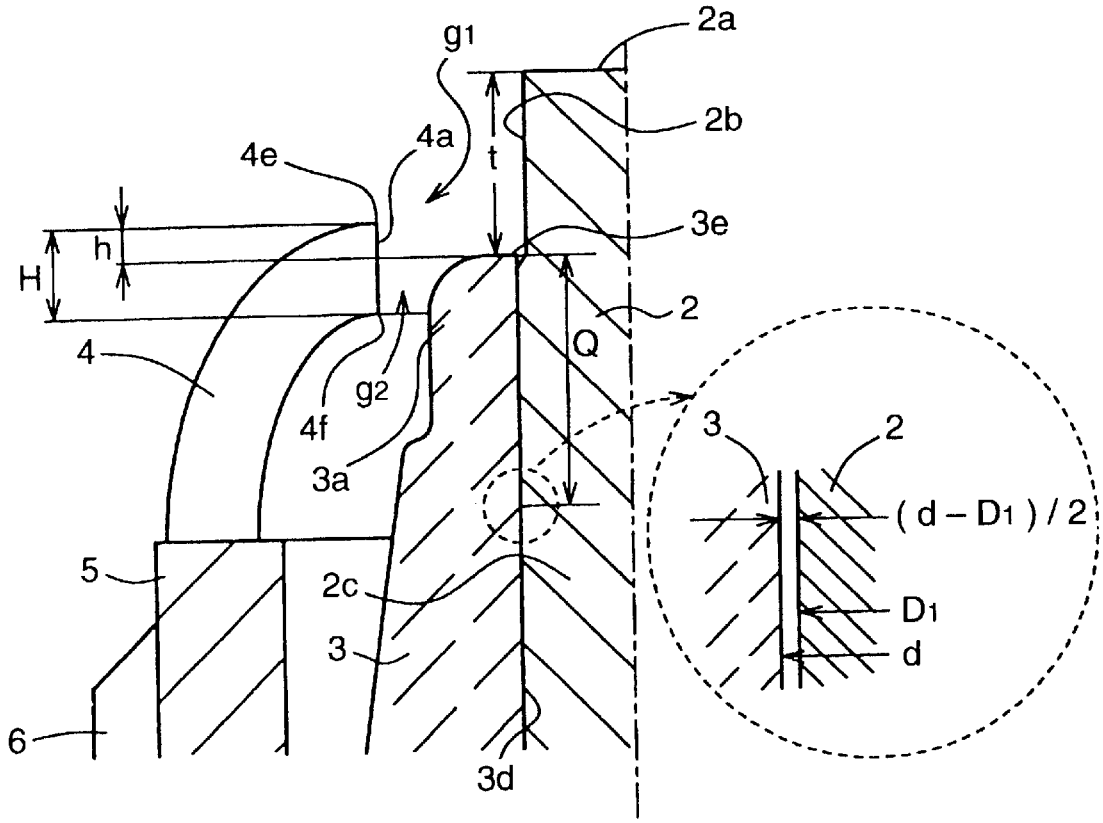
FIG. 3 is a cross sectional view showing the dimensions of respective portions of the spark plug in FIG. 2.

Here, it is desirable that, as shown in FIG. 3, a difference (d−D) between the outside diameter D of the center electrode 2 and the inside diameter "d" of the through hole 3*d* into which the center electrode 2 is inserted is 0. 07 mm or longer at a position where a distance Q measured from the top end position of the insulating member in the axial direction is 5 mm. In a case where the top end surface 2*a* of the center electrode 2 is smaller in diameter than the base end 2*c* thereof, it will suffice that a difference (d−D1) between the outside diameter D1 of the base end 2*c* and the inside diameter "d" of the through hole 3*d* is 0.07 mm or longer.

Figure 5A:
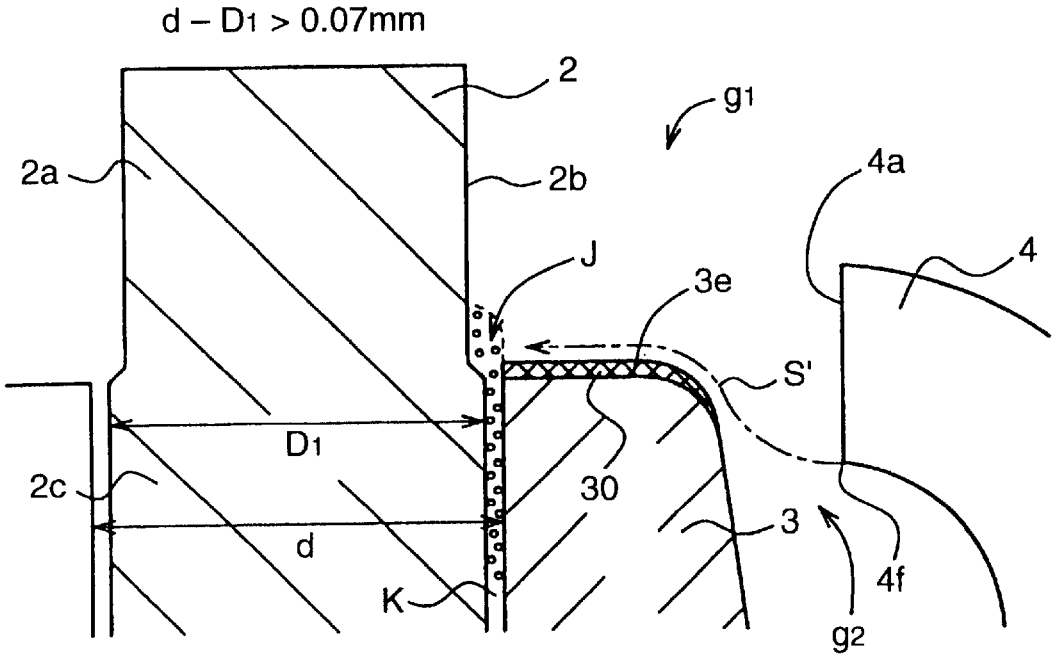
FIGS. 5A and 5B are another diagrams for explaining operations of the spark plug of FIG. 1.
Figure 5B:
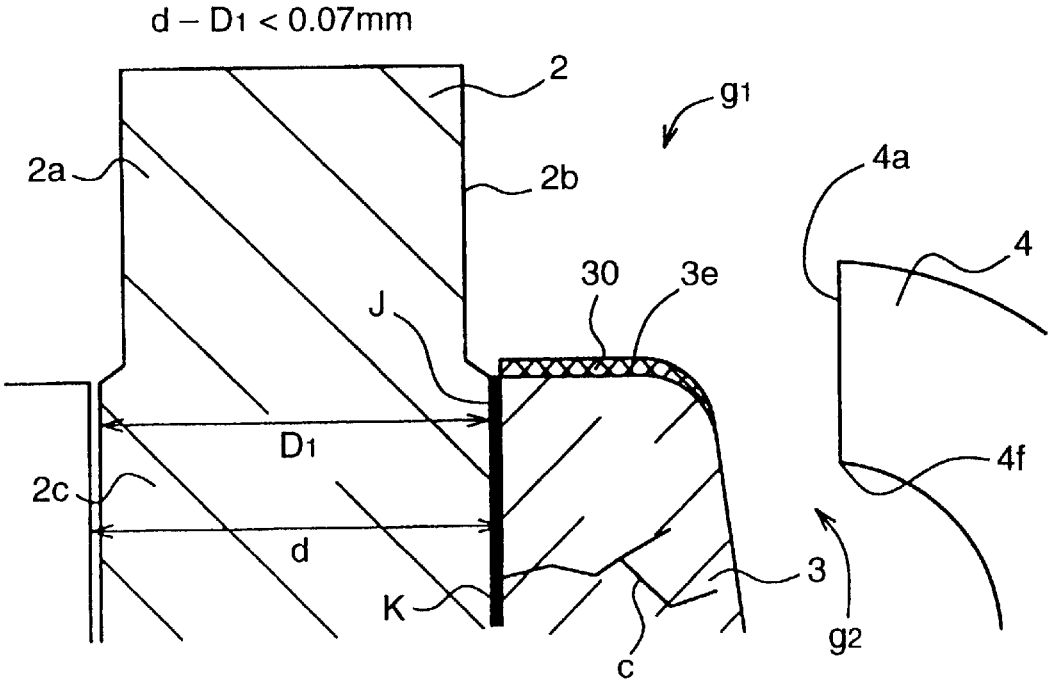

As shown in FIG. 5A, the reaction products resulting from the oxidation of the evaporated electrode metallic component do not always contribute to the formation of the corrosion impeding layer, but some part of them is deposited as dust J in a gap K between the center electrode 2 and the through hole 3*d*. There is a case that the already formed corrosion impeding layer 30 is partially cut out by the creeping discharge spark to be dust J. In this case, when the gap is small, the generated dust J is deposited and entered in the gap K at high density as shown in FIG. 5B. When it is repeatedly subjected to the heating/cooling cycle, for example, an expansion difference between the center electrode 2 and the insulating member 3 will possibly form a crack C in the insulating member 3. However, there is a less chance that the dust J is entered in the gap K at high density since the difference (d−D1) is 0.07 mm or longer. Therefore, even when it is subjected to the heating/cooling cycles, the insulating member 3 will be hard to be cracked. When the difference (d−D1) is 0.3 mm or longer, the following disadvantages are likely to occur: its heat resistance decreases, the center electrode 2 is eccentrically assembled, and the like. In this respect, it is preferable that the difference (d−D1) is selected to be 0.3 mm or shorter. More preferably, the difference (d−D1) is within a range of 0.07 to 0.15 mm.

In the case of the voltage application in a polarity where the center electrode 2 is negative, it is preferable that (d−D1) is 0.07 mm or longer. However, in the case of the voltage application in a polarity where the center electrode 2 is positive, it is possible that (d−D1) is 0.03 mm (preferably, 0.04 mm) or more.

In order to form the corrosion impeding layer 30 (FIG. 4) having good channeling restricting effects, the center electrode 2 and/or ground electrodes 4 are designed such that the firing surfaces forming portions 2*b* and 4*a*, which face the spark discharge gaps g1 and g2, are preferably made of a metallic material containing totally 10 weight % or higher of at least one of Fe, Cr and Cu. In consideration with the heat resistance of the electrodes 2 and 4, it is preferable that the firing surfaces forming portions 2*b* and 4*a* contain Ni or Fe as a main component. (In the specification, the term, "main component" means one of components constituting a material which is the highest, on weight percent basis, of those components of the material, and it does not mean "50 weight % or higher of the component" contained in the material.) Examples of the heat-resistance alloy containing Ni or Fe as a main component are:

(1) Ni Base Heat-Resistance Alloy

In the specification, it generally means a heat resistance alloy which contains 40 to 85 weight % Ni, and the remaining content of one or more of a group consisting of Cr, Co, Mo, W, Nb, Al, Ti and Fe. Specifically, the following alloys may be used (expressed all as trade names, and for the compositions of them, reference is made to an article (3rd Revised Edition Metal Data Book, p138, published by Maruzen in Japan): ASTROLOY, CABOT214, D-979, HASTELLOY C22, HASTELLOY C276, HASTELLOY G30, HASTELLOY S, HASTELLOY X, HAYNES 230, INCONEL587, INCONEL597, INCONEL 600, INCONEL 601, INCONEL 617, INCONEL 625, INCONEL 706, INCONEL 718, INCONEL X750, KSN, M-252, NIMONIC 75, NIMONIC 80A, NIMONIC 90, NIMONIC 105, NIMONIC 115, NIMONIC 263, NIMONIC 942, NIMONIC PE 11, NIMONIC PE16, NIMONIC PK33, PYROMET 860, RENE 41, RENE 95, SSS 113MA, UDIMET 400, UDIMET 500, UDIMET 520, UDIMET 630, UDIMET 700, UDIMET 710, UDIMET 720, UNITEP AF2-1 DA6, and WASPALOY.

(2) Fe Base Heat-Resistance Alloy

In the specification, it generally means a heat resistance alloy which contains 20 to 60 weight % Fe, and the remaining content of at least one of Cr, Co, Mo, W, Nb, Al, Ti and Ni. Specifically, the following alloys may be used (expressed all by trade names, and for the compositions of the alloys, reference is made to the article, 3rd Revised edition Metal Data Book, p138, published by Maruzen in Japan): A-286, ALLOY901, DISCALOY, HAYNES 556, INCOLOY 800, INCOLOY 801, INCOLOY 802, INCOLOY 807, INCOLOY 825, INCOLOY 903, INCOLOY 907, INCOLOY 909, N-155, PYROMET CTX-1, PYROMET CTX-3, S-590, V-57, PYROMET CTX-1, 16-25-6, 17-14CuMo, 19-9DL, and 20-Cb3.

To improve the channeling restricting property of the spark plug, it is effective to establish such an operation condition as to provide a less chance that the creeping discharge spark excessively attacks the insulating member 3. Specifically, it is effective to reduce as much as possible such a tendency that excessive discharge voltage instantaneously acts on the electrodes or that the voltage concentrates at one location, and to deconcentrate the voltage. For the former measure, a resistance value of the resistor member 15 of FIG. 1 is adjusted such that an electric resistance value measured between the terminal member 13 and the center electrode 2 is 2 kΩ or higher (preferably 5 kΩ or higher). The electric resistance value of the resistor member 15 may be adjusted by adjusting its constituents or size.

Figure 13A:
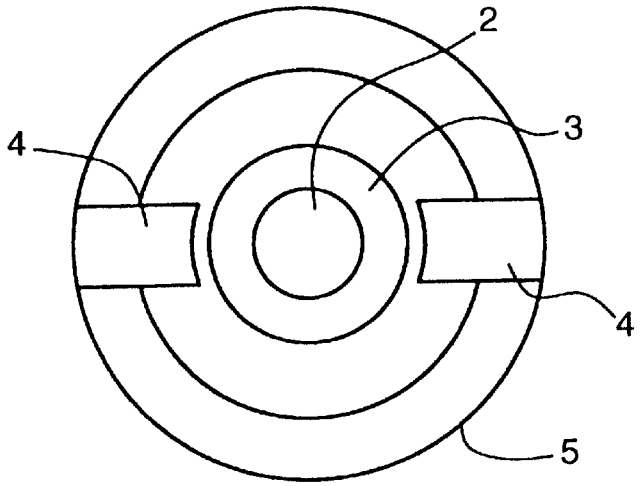
FIGS. 13A to 13C are plan views showing some examples of spark plugs each having a plurality of ground electrodes.
Figure 13B:
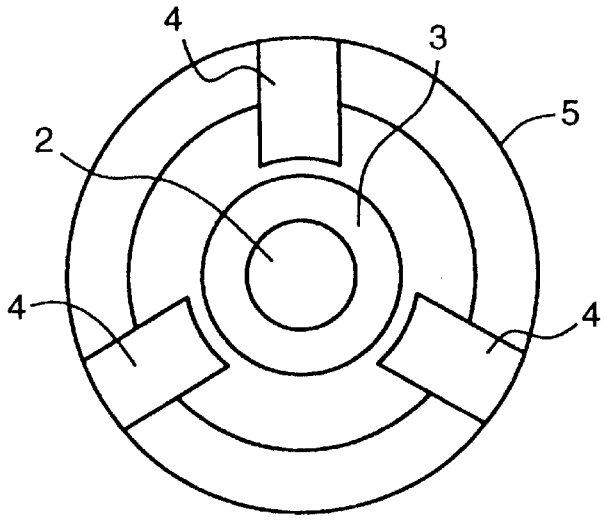
Figure 13C:
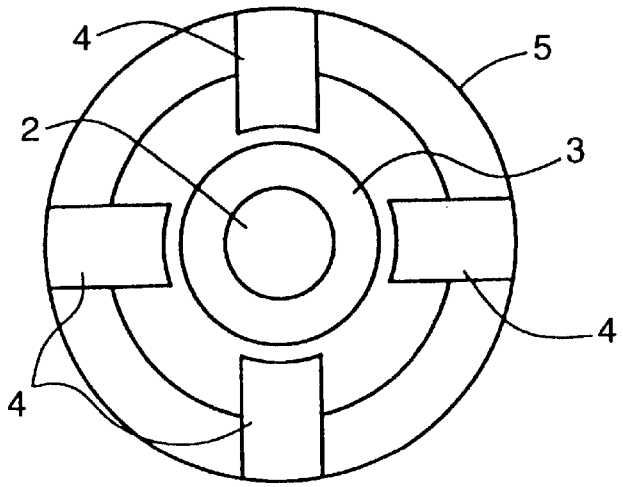

For the latter measure, it is effective to use a plurality of ground electrodes 4, not a single ground electrode, as shown in FIGS. 13A to 13C. In the example of FIG. 13B, three ground electrodes 4 are equiangularly disposed around the center electrode 2, and in the example of FIG. 13C, four ground electrodes 4 are equiangularly disposed around the same. Where the number of the ground electrodes 4 is 3 or larger, the channeling restricting property is remarkably improved.

It is advantageous to increase the axial cross section diameter D2 of the top end of the center electrode 2 in FIG. 2 since it is easy to allocate the discharge paths sparsely. In this case, it is desirable that the diameter D2 is 2.0 mm or longer. As the axial cross section diameter D2 of the top end of the center electrode 2 is decreased, the volume of the top end portion 2*a* of the center electrode 2 decreases. It less absorbs the heat of a flame caused by an ignition. As a result, the ignition performance of the spark plug is sometimes improved. Further, the area of the surface of the top end surface 2*a* of the center electrode 2 to be cleaned by spark generation or the top end of the insulating member 3 to also be cleaned is also reduced. When considering the compromising of them, the axial cross section diameter D2 of the top of the center electrode is adjusted to preferably be within a range of 0.6 to 2.2 mm. If the diameter D2 is smaller than 0.6 mm, there is a case that the channeling restricting effect is insufficient. If the diameter D2 exceeds 2.2 mm, the anti-contamination property is insufficiently secured sometimes.

Assuming that in FIG. 2, a side of the top end surface of the center electrode 2 in the axial direction O of the center electrode 2 is the front side, and the end opposite to the former is the rear side, the top end surface of the insulating member 3 is located on the front side of the rear-side edges 4*f* of the end surfaces (firing surfaces) 4*a* of the ground electrodes 4. With this structure, the channeling restricting property of the spark plug is further increased. The reason for this would be surmised that as shown in FIG. 4A, the discharge path having its end located at the rear-side edge 4*f* of the ground electrode 4, which occupies the rear side of the end surface of the ground electrode, is blocked by the insulating member 3, and hence an electric discharge emanating from the edge 4*e* of the ground electrode, which consists mainly of a gaseous discharge, is easy to occur.

Here, a ratio h/H is selected to preferably be 0.5 or less where, as shown in FIG. 3, H is a distance from the rear-side edge 4*f* of the firing surface 4*a* of each ground electrode 4 in the axial direction O of the center electrode 2, to the front-side edge 4*e* of the ground electrode, and "h" is a distance from the front end surface of the insulating member 3 to the front-side edge 4*e* of the end surface 4*a* of the ground electrode 4. If h/H is so selected, the occurrence of a discharge spark of which the discharge path has one end located at the edge 4*f* of the firing surface 4*a* of each ground electrode 4 (viz., the discharge spark is likely to creep along the surface of the insulating member) reduces in frequency. Accordingly, the channeling restricting property is further increased. "H–h", i.e., a protruded distance of the top end surface of the insulating member 3 above the rear-side edge 4*f* of the firing surface 4*a* of the ground electrode 4, is preferably 1.2 mm or smaller. If so selected, even if the rear-side edges 4*f* of the end surface of the ground electrode is located at one end of the discharge path, it is difficult that the spark strongly attacks the surface of the insulating member, and hence the channeling restricting property of the spark plug is increased.

Figure 7:
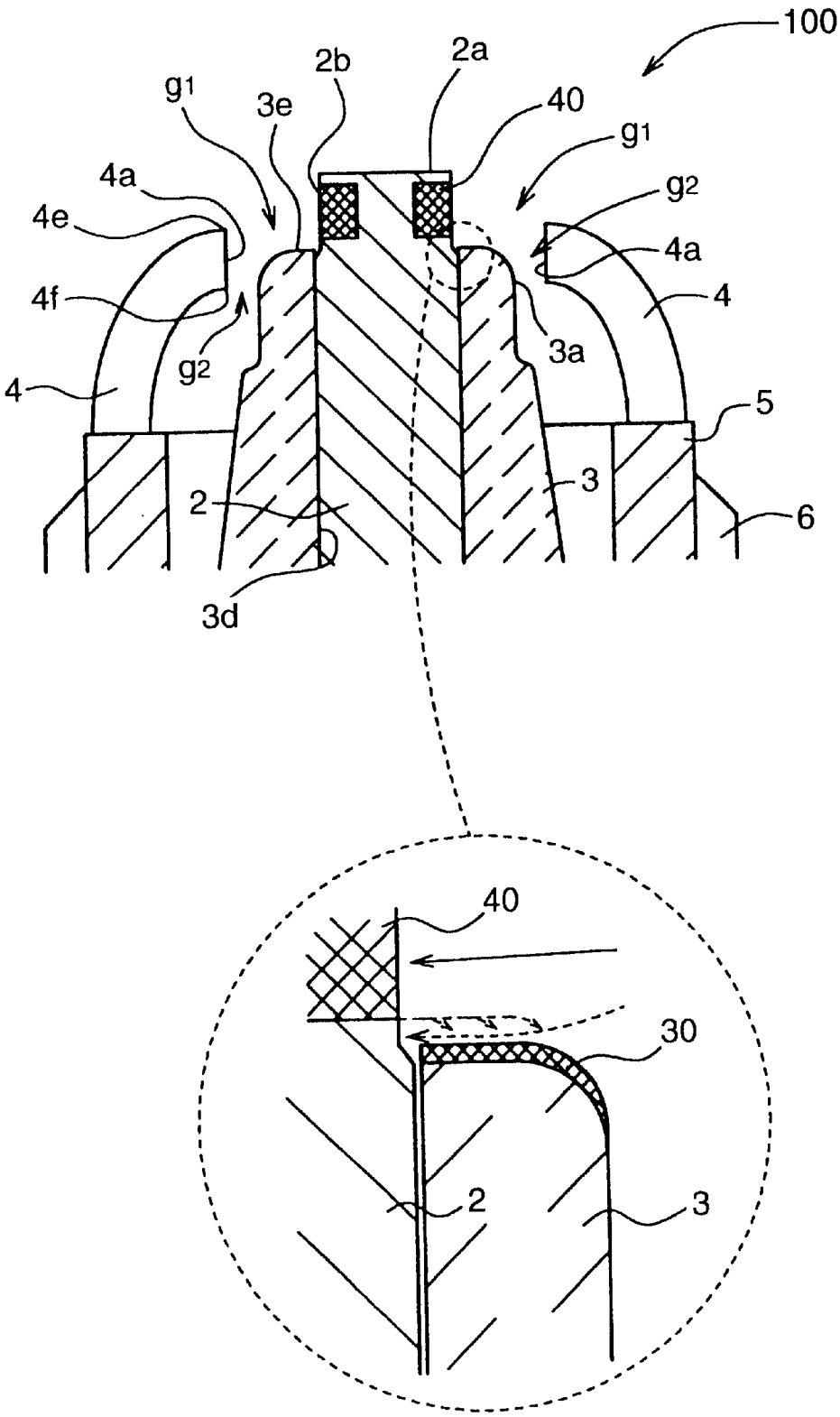
FIG. 7 is a longitudinal sectional view showing a major portion of the spark plug in which a wasting resistance portion is provided on a center electrode.

As shown in FIG. 7, in the spark plug 100, portions including parts of the firing surfaces 4*a* and 2*b* of the ground electrodes 4 and/or center electrode 2 may be used as wasting resistance portions, which are made of a metal containing a main component of at least one of Ir, Pt, Rh, W, Re and Ru or a composite material containing the metal as a main content. In the case of FIG. 7, for example, a band-shaped wasting resistance portion 40 of the spark plug 100 is formed around the outer circumferential surface (firing surface) of the top end surface 2*a* of the center electrode 2 at the mid position thereof in the axial direction. A specific material of the band-shaped wasting resistance portion 40 may be a Pt—Ni alloy, e.g., an alloy containing Pt as a main content and 6 weight % or higher of Ni.

The band-shaped wasting resistance portion 40 may be formed in a manner that a chip made of the above-mentioned material or the composite material is fixed thereto by welding. The material of the band-shaped wasting resistance portion 40 is selected to be excellent in heat-resistance and corrosion proof, and hence the wearing of the band-shaped wasting resistance portion 40 is lessened. As a result, the durability of the spark plug 100 is improved. The band-shaped wasting resistance portion 40 may be formed including the edges of the front face of the center electrode 2.

Figure 8A:
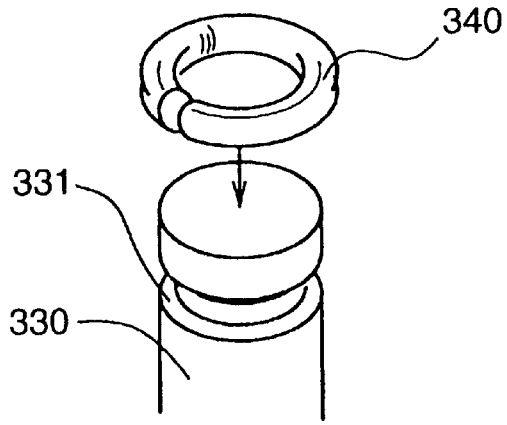
FIGS. 8A to 8D are diagrams showing a sequence of steps in a method of forming a wasting resistance portion on the outer circumferential surface of the center electrode.
Figure 8B:
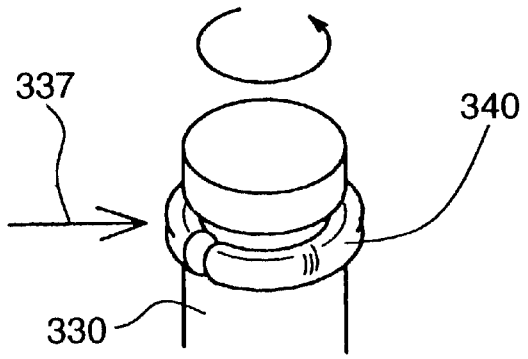
Figure 8C:
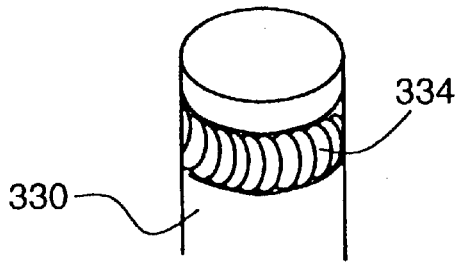
Figure 8D:
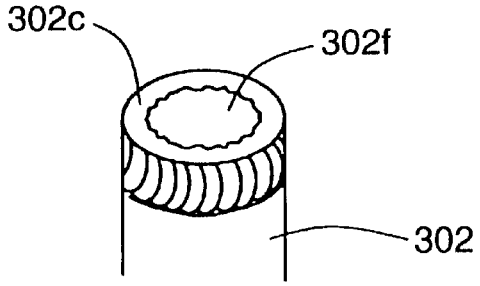

The wasting resistance portion 40 may be formed in the following way, for example. As shown in FIG. 8A, a groove (trapezoidal in cross section) 331 is formed around the top end of an electrode blank 330 made of Ni, which will become an center electrode 2, and an annular ring 340 of Pt (e.g., a Pt wire rounded in a ring) is fit into the groove 331. A laser beam 337 is projected to the annular ring 340 while the electrode blank 330 is rotated at a given speed. As a result, the Pt member 340 and the electrode blank 330 are molten as shown in FIG. 8B, so that a Pt—Ni alloy portion 334 (to be the wasting resistance portion 40) is formed. The irradiation condition of the laser beam and the size of the annular ring 340 are adjusted so that an Ni content of the Pt—Ni alloy portion 334 to be formed is 15 weight % or higher. Where the wasting resistance portion 40 is formed including the edges of the top end surface of the center electrode 2, the top end of the electrode blank 330 is cut out by cutting, grinding, machining or the like so as to expose the firing surface 302*c* based on the Pt—Ni alloy portion 334.

Figure 6:
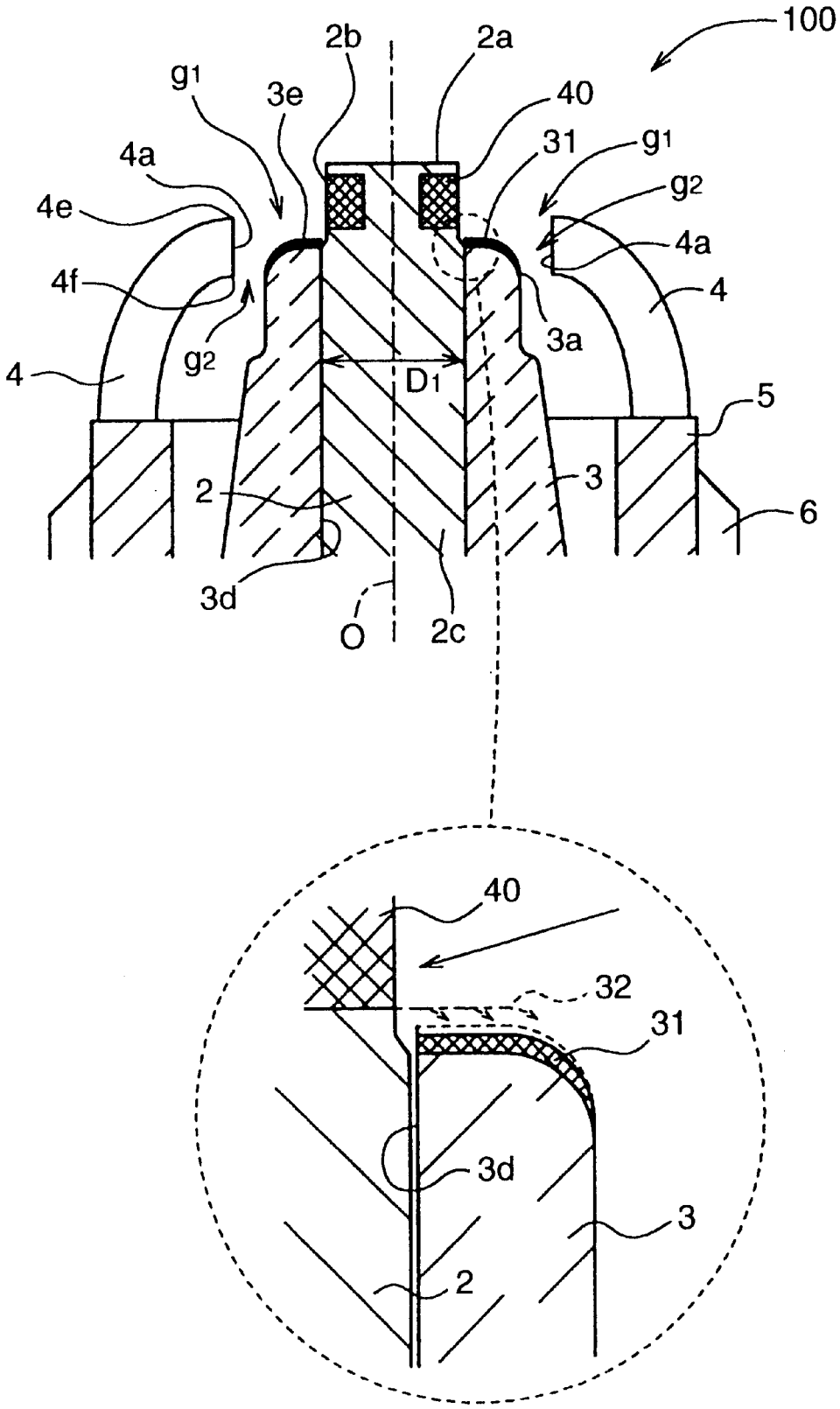
FIG. 6 is a longitudinal sectional view showing a major portion of the spark plug in which a corrosion impeding layer is formed in advance on the surface of the insulating member.

When the wasting resistance portion 40 is circumferentially formed on the outer circumferential surface of the center electrode 2 as shown in FIG. 6, the wasting resistance portion 40 is preferably formed so as not to extend over a region extending both ends of the top end of the insulating member 3 in the axial direction O of the center electrode 2. More specifically, it is preferable to form the wasting resistance portion 40 so that the metallic material surface of the main body of the center electrode 2, which contains Fe, Cr and Cu as insulating-member corrosion impeding components, faces on the opening edge of the through hole 3*d* of the insulating member 3. With this structure, a creeping discharge spark, when occurs, hits the metallic material surface. As a result, the supply of the insulating-member corrosion impeding component is promoted, and hence the formation of the corrosion impeding layer 30 is promoted, whereby the channeling restricting effect is improved.

Figure 9A:
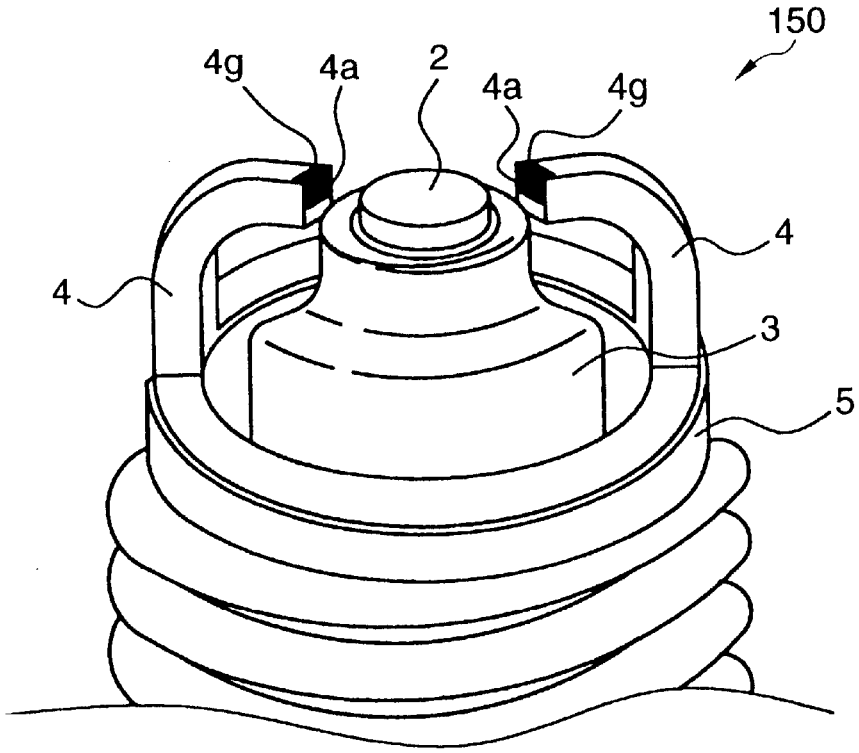
FIGS. 9A to 9C are explanatory diagrams showing an example of forming a wasting resistance portion on the end surfaces of ground electrodes and a method of forming the same as well.
Figure 9B:
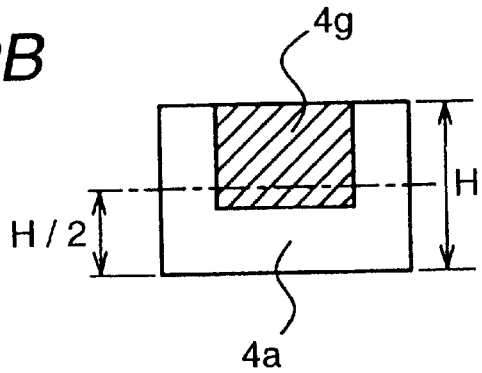

At least a part of the firing surface 4*a* of the top end of the ground electrode 4 of the spark plug 150 may be formed as a wasting resistance portion 4*g* as shown in FIG. 9A. A specific material of the wasting resistance portion 4*g*, like the wasting resistance portion 40, may be a Pt—Ni alloy containing Pt as a main content and 15 weight % or higher of Ni. In this instance, as shown in FIG. 9B, a wasting resistance portion 4*g* is formed including a part of a region spreading frontward from the rear side edge of the firing surface 4*a* of each ground electrode 4 beyond a distance H/2 where H is a distance from the rear side edge of the front end surface 4*a* of the ground electrode 4 to the front side edge. A material of the wasting resistance portion 4*g* is excellent in heat resistance and corrosion resistance. Therefore, wasting of the top end surfaces 4*a* of the ground electrodes 4 are lessened, whereby the durability of the spark plug 150 is improved.

Figure 9C:
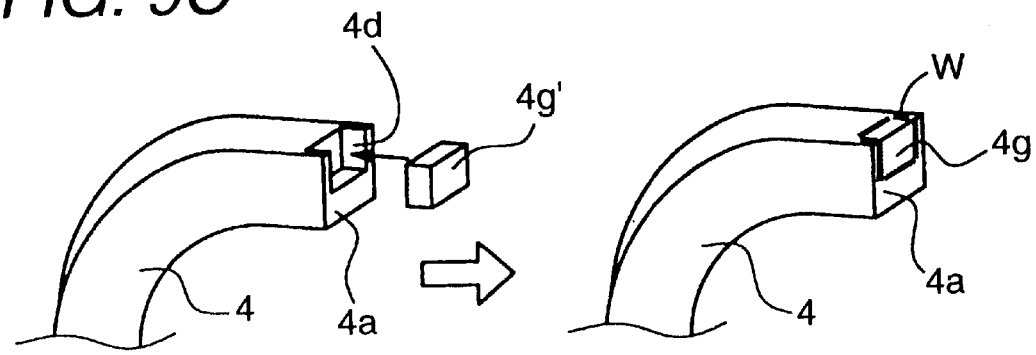

As shown in FIG. 9C, the wasting resistance portion 4*g* may be formed such that a chip 4*g*' made of the above-mentioned metal or composite material is fixed to the end surface 4*a* by laser or resistance welding. In this instance, a concavity 4*d* is formed in the end surface 4*a* of the ground electrode, the chip 4*g*' is fit into the concavity, and a welding part W is formed along a boundary between them.

The wasting resistance portions may be formed on both the center electrode 2 and ground electrodes 4 such that the wasting resistance portion 40 (FIG. 7) is formed on the center electrode 2 and the wasting resistance portions 4*g* are formed on the ground electrodes 4. In a case where the wasting of the ground electrodes 4 is problematic not so much, only the wasting resistance portion 40 is provided on the center electrode 2, while the wasting resistance portions 4*g* are not provided on the ground electrodes 4. The voltage may be applied to the spark plug 100 in the reverse polarities when comparing with the above-mentioned case: the voltage is applied to the spark plug such that the center electrode 2 is electrically positive. In this case, only the wasting resistance portions 4*g* may be provided on the ground electrodes 4.

In the above-mentioned spark plug 1, as shown in FIGS. 4A and 4B, a corrosion impeding layer 30, which is formed from the metallic material forming the firing surface 2*b* or the firing surfaces 4*a*, is formed on the surface of the insulating member when the spark plug 1 is operated. Substantially the same effects as of the above-mentioned spark plug 1 may also be achieved by a spark plug 100 in which as shown in FIG. 6, a corrosion impeding layer 31 is formed in advance on the surface of the insulating member 3. In this case, the corrosion impeding layer 31 may be made mainly of an oxide group semiconducting compound containing at least one of Fe, Cr, Cu and Sn as a cation component. The corrosion impeding layer 31, which is made of the oxide group semiconducting compound, may be formed by any of various vapor phase film forming process, such as high frequency sputtering, reaction sputtering and ion plating, or the sol-gel process in which an oxide sol is prepared by hydrolyzing metal alcoxide, and it is applied to the insulating member and dried to be gelatinized.

In this case, a material of the center electrode 2 and/or ground electrodes 4 is not limited to a specific one, but it may be a metallic material containing at least one of Fe, Cr and Cu as an insulating-member corrosion impeding component. With progression of a spark discharge, a reaction product 32 containing the insulating-member corrosion impeding component is deposited on the corrosion impeding layer 31 already formed on the surface of the top end 3*a* of the insulating member 3. This replenishes the corrosion impeding layer 31, which will be reduced in thick by the creeping discharge. The result is to enhance the continuation of the channeling restricting effect.

Figure 10:
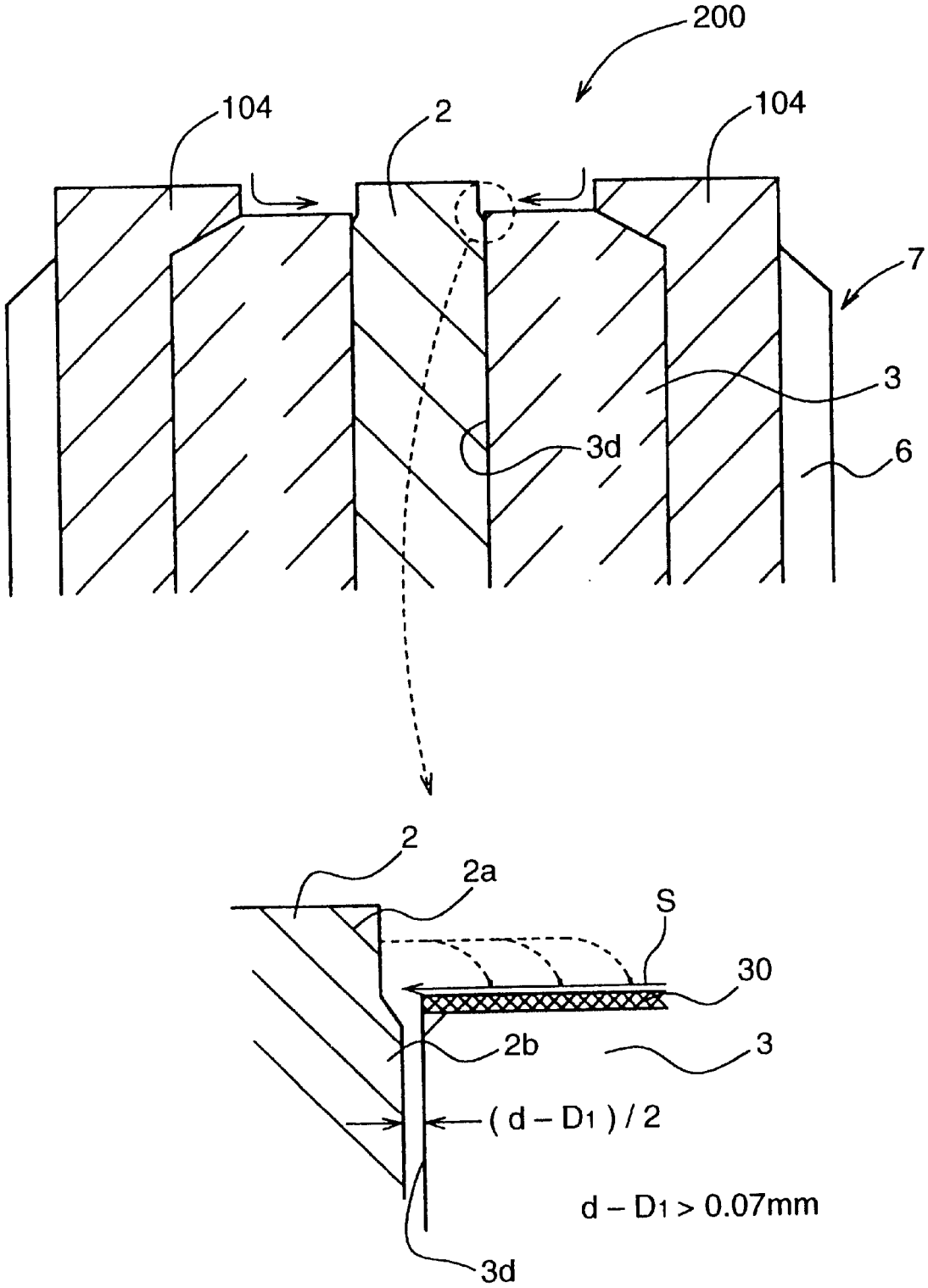
FIG. 10 is a longitudinal sectional view showing a major portion of a full creeping discharge type spark plug incorporating the present invention.

While the semi-creeping discharge type spark plug has been described as the embodiment of the invention, the present invention is not limited to such a spark plug. Some modifications of the invention will be described (in the description, like or equivalent portions of the spark plug 1 are designated by like reference numerals for simplicity). A spark plug shown in FIG. 10 is a full creeping discharge type spark plug 200 constructed such that the inner surfaces of ground electrodes 104 are brought into contact with the surface of the insulating member 3, whereby a creeping discharge is caused over substantially the entire length of the discharge paths between them and the center electrode 2.

Figure 11:
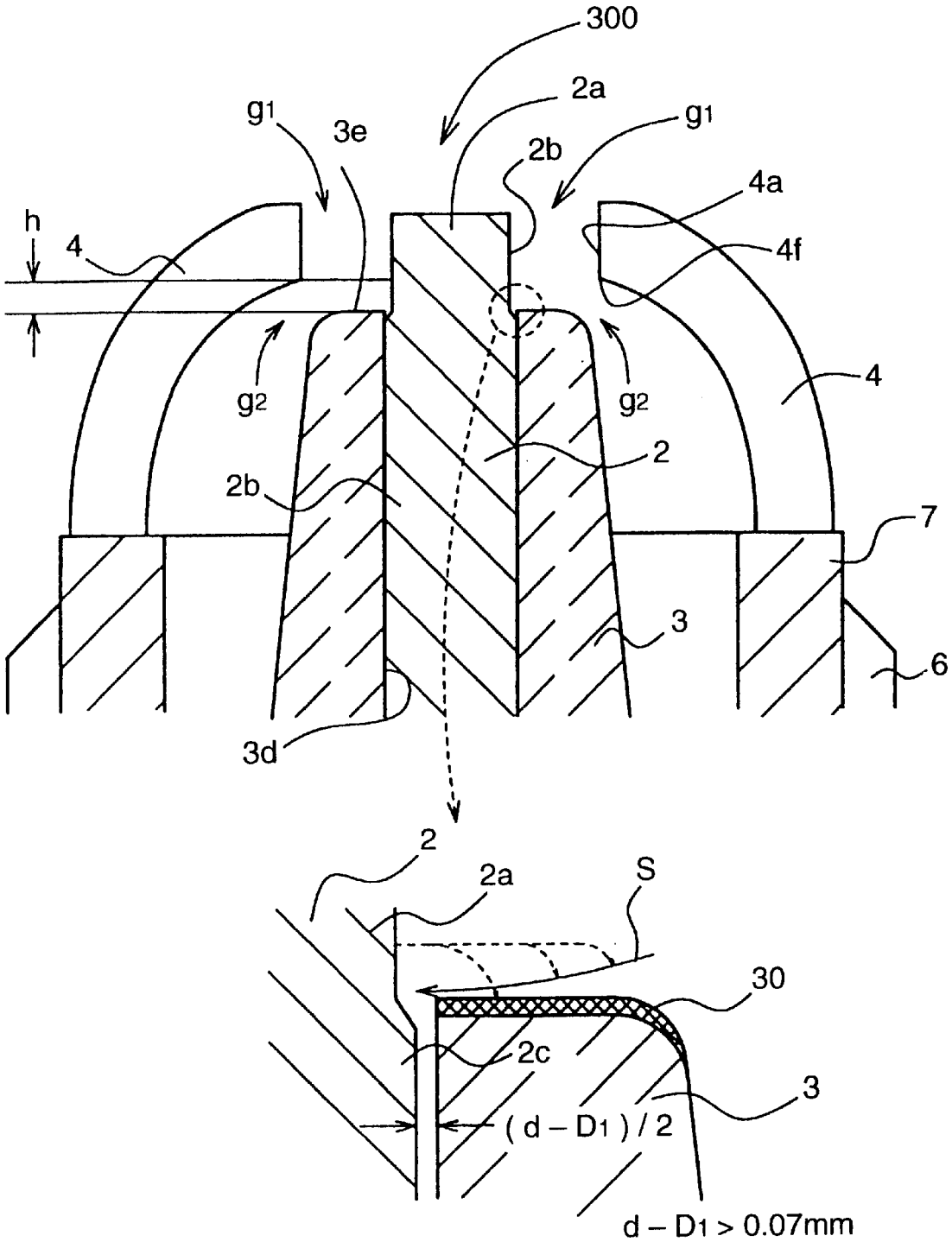
FIG. 11 is a longitudinal sectional view showing a major portion of an intermittent creeping discharge type spark plug incorporating the present invention.

In a spark plug 300 shown in FIG. 11, the top end of the insulating member 3 is not located (in the first gap g1 located) between the outer circumferential surface 2*b* of the protruded portion 2*a* of the center electrode 2 and the top end surfaces 4*a* of the ground electrodes 4. A distance (second gap g2 located) between the top end surface 3*e* of the insulating member 3 and the rear-side edges 4*f* of the end surfaces 4*a* of the ground electrodes 4 is selected to be small when comparing with a distance between the outer circumferential surface 2*b* of the protruded portion 2*a* of the center electrode 2 and the top end surface 4*a* of each ground electrode 4. Thus, the top end surface 2*a* of the center electrode 2 is disposed projecting from the insulating member 3, and a main metallic shell 7 is provided covering the outside of the insulating member 3. The base ends of the ground electrodes 4 are coupled to the end of the main metallic shell 7, while the top ends thereof are bent toward the center electrode 2. The end surfaces 4*a* of the ground electrodes are disposed facing the top end 2*a* of the center electrode 2, thereby forming a first gap g1. The inner surfaces of the top ends of the ground electrodes 4 are opposed to the top end surface 3*e* of the insulating member 3, thereby forming a second gap g2 smaller than the first gap g1. This spark plug is of the called intermittent creeping discharge type in which only when the contamination on the insulating member 3 progresses, a spark discharge is performed in the second gap g2.

In the thus constructed embodiment, "h" is adjusted to be preferably 0.3 mm or longer, more preferably 0.4 mm or longer where "h" is a distance between the rear-side edges 4*f* of the end surfaces 4*a* of the ground electrodes 4 in the axial direction of the center electrode 3 and the top end surface 3*e* of the insulating member 3 on the assumption that a side of the top end surface of the center electrode 2 in the axial direction is the front side, and the end opposite to the former is the rear side. Thus, the second gap g2, in which a discharge to be carried out will take the form of a creeping discharge, is selected to be relatively large, so that the channeling restricting property is more improved. Where "h" is in excess of 0.7 mm, the discharge voltage in the second gap g2 becomes excessively high, and the function of the intermittent creeping discharge spark plug is sometimes unsatisfactory. In this respect, it is preferable that "h" is selected to be 0.7 mm or less.

Figure 12A:
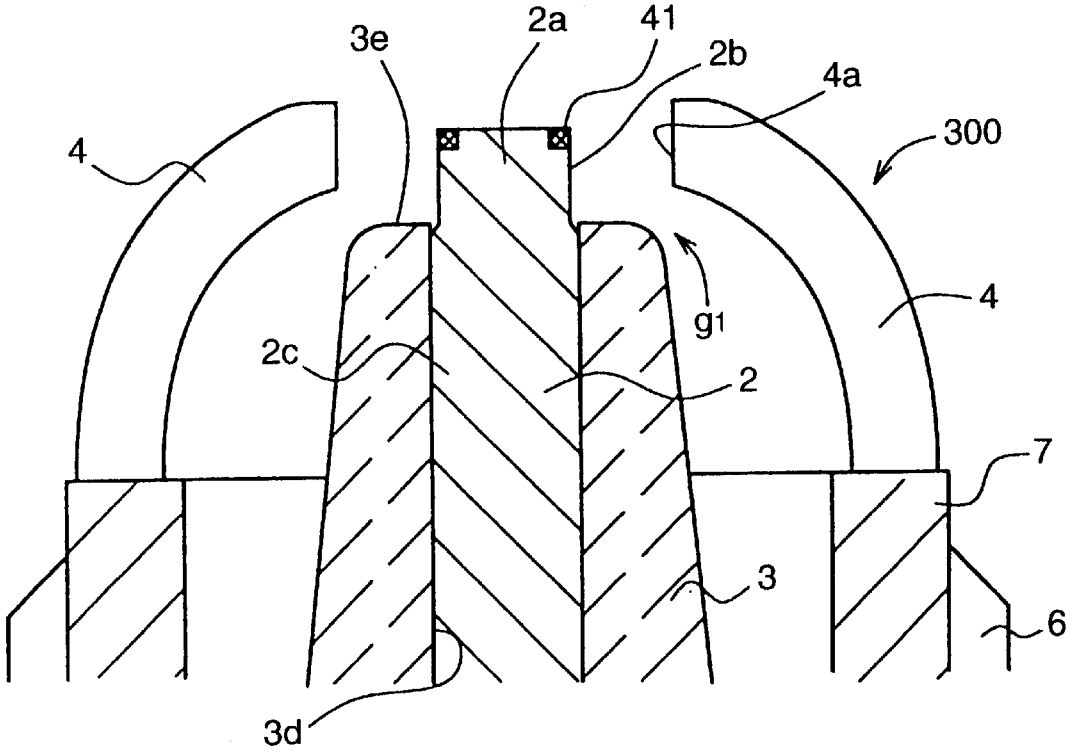
FIGS. 12A and 12B are longitudinal sectional views showing a major portion of the spark plug, some examples of forming a wasting resistance portion on the outer circumferential surface of the center electrode.
Figure 12B:
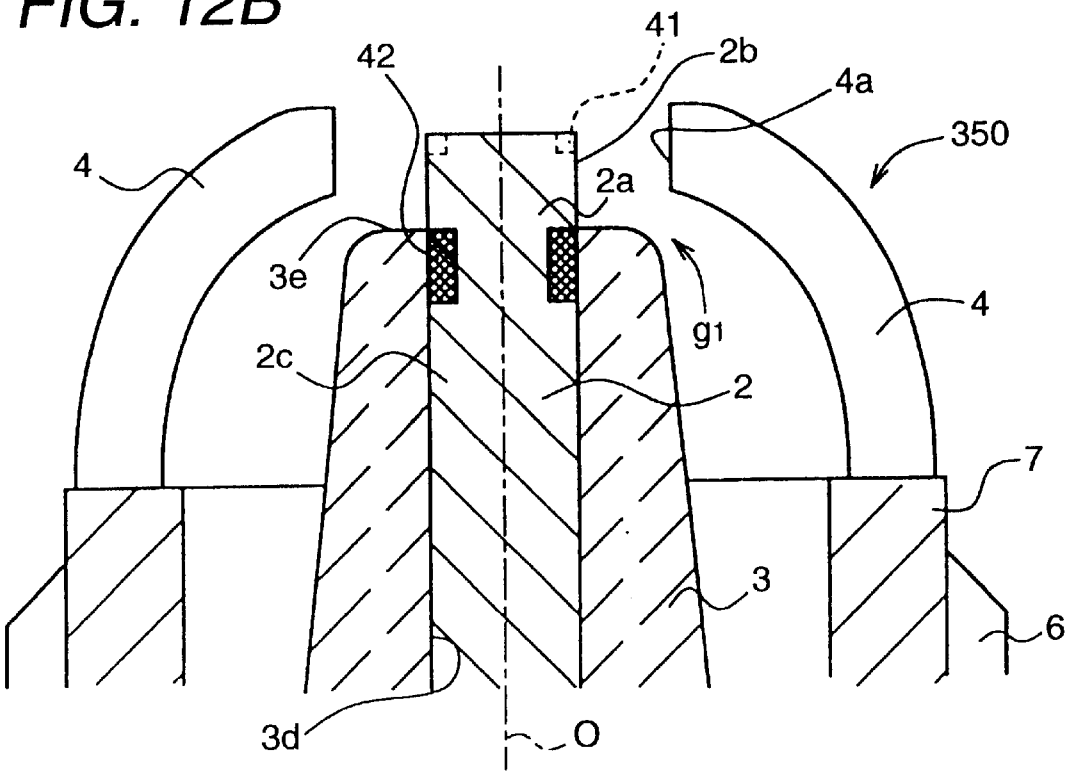
Figure 14:
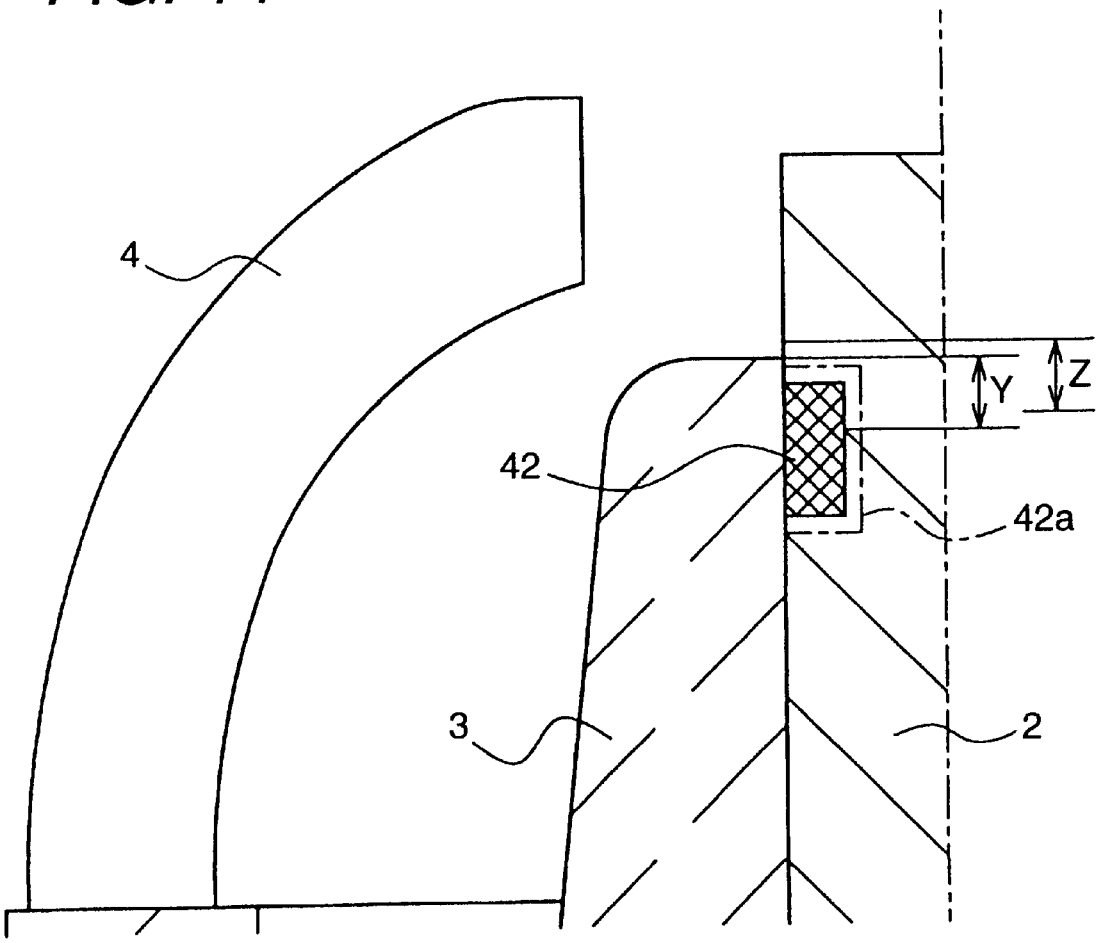
FIG. 14 is an enlarged view showing a preferable position where a band-shaped wasting resistance portion is formed provided on the outer circumferential of the center electrode.

Also in this embodiment, as shown in FIG. 12, a wasting resistance portion 41 or 42 may be provided on the center electrode 2, like the wasting resistance portion 40. In FIG. 12A, a wasting resistance portion 41 is formed including the top end edge of the center electrode 2. In FIG. 12B, a wasting resistance portion 42 is formed within the through hole 3*d* of the insulating member 3 (viz., it is formed not extending over regions located on both sides of the top end position of the insulating member 3 in the axial direction O of the center electrode 2). Particularly, as shown in FIG. 14, a side toward the top end of the center electrode 2 in the axial direction O of the center electrode 2 is set as a front direction side. If the edge of the front direction side (referred "front end edge") of the wasting resistance portion 42 is within a section Y, which is from the top end edge of the insulating member 3 to 0.5 mm backward position in the axial direction, a creeping discharge spark attacks further effectively the metallic material surface of the main body of the central electrode 2. Thus, the above-described effect can be further enhanced. If the front end edge surface of the wasting resistance portion 42 moves 0. 5 mm or more backward from the top end edge, the position of the wasting resistance portion 42 departs from the position where spark is received and it is hard to contribute to restrict the electrode wasting.

In the case where the metallic material of the main body of the center electrode contains Fe and Cr, a melting portion 42*a*, where the composition metal of the wasting wearing portion and that of the center electrode are melted and mixed, is formed around the circumferential of the wasting resistance portion 42. The melting portion 42*a* contains Fe and Cr, the amount of which is less than that of the composition metal of the center electrode. Accordingly, it is possible to contribute to form the corrosion impeding layer. Taking this into consideration, the region where the total amount of Fe and Cr is more than 7 weight % is preferably within a section Z between 0.5 mm forward from the top end portion of the insulating member and 0.3 mm backward from the top end portion of the insulating member in the axial direction. If the front end edge portion of the region 42*a* exceeds 0.5 mm forward from the top end portion of the insulating member, the formation of the corrosion impeding layer is apt to be inhibited. On the other hand, it exceeds 0.3 mm backward from the top end portion of the insulating member, the position of the wasting resistance portion 42 departs from the position where spark is received and it is hard to contribute to suppress the electrode wasting.

Figure 15:
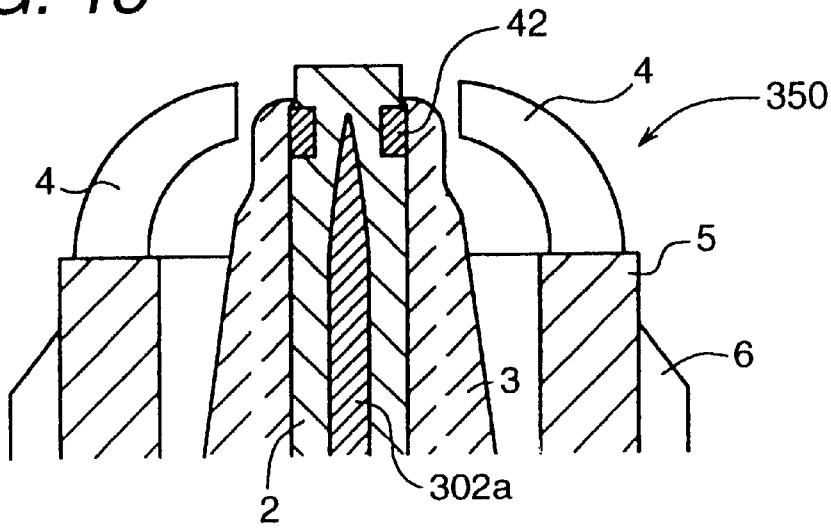
FIG. 15 is a longitudinal section view showing a major portion of a semi-creeping type spark plug in which a band-shaped wasting resistance portion is provided.

Incidentally, FIGS. 12A and 12B show examples in which the wasting resistance portion 41, 42 is formed on the center electrode 2 of the interval creeping discharge type spark plug. As shown in FIG. 15, the wasting wearing portion 42 is formed in the similar manner in a semi-creeping discharge type spark plug. Incidentally, in the example shown in FIG. 15, a thermal radiation acceleration metal portion 302*a* composed of Cu or Cu alloy is formed in the center electrode 2.

Figure 16A:
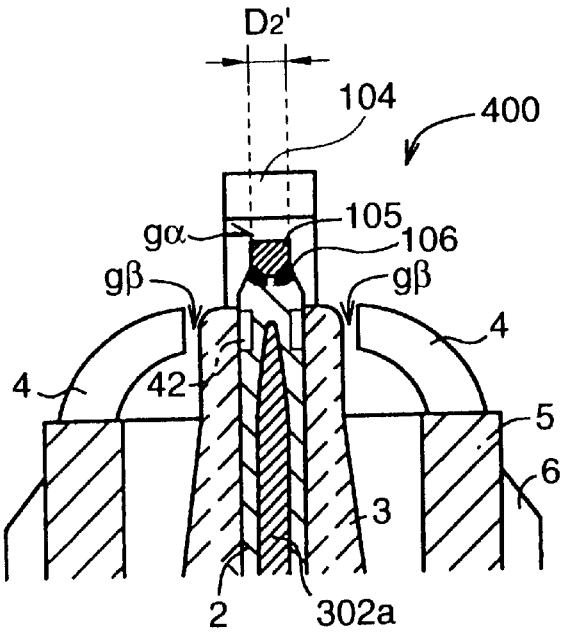
FIGS. 16A and 16B are front and side section views showing a major portion of the spark plug in which a ground electrode opposing to the top end surface of the center electrode and a ground electrode opposing to the side surface of the center electrode.
Figure 16B:
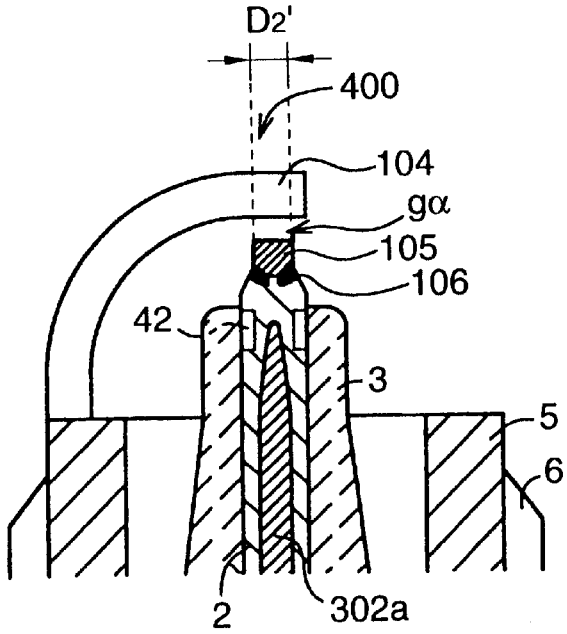

In any of the spark plugs of the above-described embodiments, the surface of the top end portion of the ground electrode is opposed to the side surface of the center electrode. However, the scope of the present invention includes an embodiment in which the top end portion of a part of a plurality of ground electrodes is not necessarily opposed to the side surface of the center electrode. One example is shown in FIG. 16A (plan view) and FIG. 16B (side view). As similar to the spark plug 300, 350 in FIGS. 12A and 12B and the like, in a spark plug 400, the cylindrical main metallic shell 5 is so provided that it covers the outer side of the insulating member 3. A plurality of ground electrodes 4, 104 is so provided that a base end side is joined to the end portion of the main metallic shell 5 and a top end side is bent toward the side of the center electrode 2. One of the ground electrodes, i.e., the ground electrode 104 is so disposed that the side surface is opposed to the top end portion of the center electrode. On the other hand, the remaining at least one ground electrode 4 (two ground electrodes in this embodiment) is so disposed that the end surface is opposed to the side surface of the center electrode 2.

In the above structure, a spark discharge gap gα similar to a parallel opposing type spark plug is formed between the side surface of the ground electrode 104 and the top end surface of the center electrode 2. If the gap gα is set larger than the gap gβ, spark discharge is generally performed in the gap gα but in case of fouling the top end surface of the insulating member 3, spark discharge is performed in the gap gβ. The spark discharge, which is similar to the parallel opposing type spark plug, highly concentrates to the gap gα (particularly, in case of applying voltage when the center electrode side is negative), thereby enhancing ignitability. Also in this case, a difference (d−D1) between the outside diameter D of the center electrode and the inside diameter "d" of the through hole, into which the center electrode is inserted, is 0.07 mm or longer at a position where is 5 mm separated from the top end position of the insulating member in the axial direction. Incidentally, in this embodiment, the ground electrode 4, which is so disposed that the side surface is opposed to the top end surface of the center electrode, is opposed to the side surface of the center electrode while they sandwiches the top end portion of the insulating member. That is, the discharge in the gap gβ becomes the semi-creeping discharge as similar to FIG. 2 or the like.

During normal period, some discharge is performed in the gap gβ. Particularly, under the condition where the top end portion of the insulating member 3 is not fouled, no little discharge is performed in the gap gβ. Since the discharge in the gap gβ is semi-creeping discharge, the wasting of the center electrode at the side surface of the top end portion corresponding to the top end surface of the insulating member should be considered. Accordingly, the axial cross section diameter D2' of the top end of the center electrode 2 corresponding to the top end surface of the insulating member is preferably 2.0 mm or more. If the axial cross section diameter D2' is large, the discharge path is apt to disperse, whereby it has an advantage in view of wasting resistance.

A wasting wearing portion 105 is joined to the top end portion of the center electrode 2 by an annular welding portion 106. The wasting wearing portion 105 is made of a metallic material containing a main component consisting of one or more of Ir, Pt, Rh, W, Re and Ru or a composite material containing the metallic material as a main content. Incidentally, a wasting wearing portion 42 as similar to that shown in FIG. 12B may be formed on the outer circumferential surface of the center electrode 2. Further, a thermal radiation acceleration metal portion 302*a* composed of Cu or Cu alloy is formed in the center electrode 2.

EXAMPLE

In order to confirm the useful effects of the invention, the spark plug shown in FIGS. 1 and 2 was tested in the following ways. In FIG. 2, the first gap g1 was 1.6 mm, and the second gap g2 was 0.6 mm. In FIG. 3, H was 1.5 mm and "h" was 1.0 mm (h/H=0.67). The outside diameter D2 of the top end surface 2*a* of the center electrode 2 was 2.0 mm, and the outside diameter D1 of the base end 2*c* was 2.1 mm. The difference "d−D1" was within a range of 0.05 to−0.2 mm by selecting the inside diameter "d" of the through hole 3*d* of the insulating member 3 to be within 2.15 to 2.3 mm. A material center electrode 2 and the ground electrodes 4 was an Ni–Cr–Fe alloy (Cr: 15 weight %, Fe : 8 weight %, and the remainder: Ni). The insulating member 3 was an alumina sintered member. For comparison, a spark plug of the center electrode 2 and the ground electrodes 4 both made of an Ni—W alloy (W: 4 weight % and the remainder: Ni) was also produced.

To examine the channeling restricting property of the spark plug, those spark plugs were attached to 6-cylinder gasoline engines (displacement volume: 2000 cc). The engines were operated in a full-throttle state, at 5000 rpm of engine speed, and for 200 hours. Depth of channeling grooves formed in the surfaces of the insulating members 3 were measured by use of a scanning electron microscope (the voltage was intermittently and its frequency was 60 Hz). For evaluating the channeling grooves, three levels of low, medium and high levels were used. The low level (◎) indicates that the groove depth is smaller than 0.2 mm. The medium level (○) indicates that the groove depth is within 0.2 to 0.4 mm. The high level (×) indicates that the groove depth is 0.4 mm or larger.

The spark plugs were subjected to heating/cooling cycle tests. In the test, repeated is one cycle, in which an operation in full throttle state at 5000 rpm of engine speed and for one minute and idling for one minute. After the tests, for evaluations, the spark plugs of which the insulating members were cracked before 150 hours were marked with "×", those were cracked between 150 hours to less than 250 hours were marked with "Δ" and those free from the cracking until 250 hours were marked with "○". After the tests, the test pieces of the spark plugs were longitudinally cut. Dust deposition in the gap between the center electrode 2 and the through hole 3*d* of the insulating member of each test piece was checked by the eye. The test results are exhibited in Table 1.

TABLE 1

| | | | Channeling | Heating/cooling Cycle Evaluation Result | |
|---|---|---|---|---|---|
| | (d-D1) (mm) | Electrode Material | Evaluation Result | Negative Property | Positive Property |
| 1 | 0.03 | Ni—Cr—Fe | ◎ | — | Δ |
| 2 | 0.04 | Ni—Cr—Fe | ◎ | × | ○ |
| 3 | 0.05 | Ni—Cr—Fe | ◎ | × | ○ |
| 4 | 0.07 | Ni—Cr—Fe | ◎ | ○ | ○ |
| 5 | 0.08 | NI—Cr—Fe | ◎ | ○ | ○ |
| 6 | 0.09 | Ni—Cr—Fe | ◎ | ○ | ○ |
| 7 | 0.10 | Ni—Cr—Fe | ◎ | ○ | ○ |
| 8 | 0.15 | Ni—Cr—Fe | ◎ | ○ | ○ |
| 9 | 0.20 | Ni—Cr—Fe | ◎ | ○ | ○ |
| 10 | 0.25 | Ni—Cr—Fe | ◎ | ○ | ○ |
| 11 | 0.10 | Ni—W | × | ○ | ○ |

As seen from the table, in the comparison example of the spark plug of which the center electrode 2 and the ground electrodes 4 are made of an Ni—W alloy, the channeling was remarkable. In the spark plugs of the embodiment of which the center electrode 2 and the ground electrodes 4 are made of an Ni—Cr—Fe alloy, the channeling was markedly reduced. In the spark plugs of the embodiments, it was confirmed that a corrosion impeding layer containing mainly an Ni—Cr—Fe group composite oxide was formed on the surface of the insulating member 3. On the other hand, formation of such a corrosion impeding layer was not confirmed.

From the results of the heating/cooling cycle test, when the polarity of the center electrode is negative, it is seen that when the difference "d−D1" is selected to be 0.07 mm or longer, the cracking of the insulating member 3 is effectively and remarkably restricted. When the polarity of the center electrode is positive, it is seen that when the difference "d−D1" is selected to be 0.03 mm or longer, the cracking of the insulating member 3 is restricted. It is difficult to set the difference "d−D1" to be less than 0.03 mm in manufacturing. Further, due to the difference of the thermal expansion ratio between the insulating member and the center electrode, the crack or the like is apt to occur. Accordingly, it is actually impossible to employ it. Incidentally, in the case where the polarity of the center electrode is negative, in the test piece No. 1 in which "d−D1" was 0.05 mm, it was confirmed that the insulating member 3 was cracked. When observing the cross-section of it, it was found that dust was highly densely deposited in the gap between the center electrode 2 and the through hole 3*d* of the insulating member.

What is claimed is:

1. A spark plug comprising:

a center electrode;

an insulating member disposed around said center electrode in a state that a top end of said center electrode is exposed at a top end of said insulating member;

a main metallic shell provided covering at least a portion of said insulating member;

a ground electrode forming a spark discharge gap between the top end of said center electrode and a top end of said ground electrode, and being positioned relative to the top end of said insulating member and the top end of said center electrode so as to allow creeping discharge to be performed along the surface of the top end of said insulating member; and a corrosion impeding layer formed on at least a portion of the surface of the top end of said insulating member, wherein at least one of said center electrode and said ground electrode contains at least one corrosion impeding component of a type contained in said corrosion impeding layer.

2. The spark plug according to claim 1, wherein said corrosion impeding layer contains at least one of Fe, Cr and Cu as the corrosion impeding component.

3. The spark plug according to claim 1, wherein said corrosion impeding layer is formed on the surface of the top end portion of said insulating member prior to using said spark plug.

4. The spark plug according to claim 3, wherein said corrosion impeding layer contains at least one of Fe, Cr, Cu and Sn as a corrosion impeding component.

5. The spark plug according to claim 2, wherein said corrosion impeding layer comprises an oxide compound of said corrosion impeding component.

6. The spark plug according to claim 1, wherein a difference (d−D) between the outside diameter D of said center electrode and the inside diameter (d) of a through hole into which said center electrode is inserted is 0.07 mm or longer at a position approximately 5 mm from a top end position of said insulating member in an axial direction.

7. The spark plug according to claim 1, wherein a voltage is applied in a polarity such that said center electrode side is positive with respect to said ground electrode; and the difference (d−D) between the outside diameter D of said center electrode and the inside diameter "d" of a through hole into which said center electrode is inserted is 0.03 mm or longer at a position approximately 5 mm from a top end position of said insulating member in an axial direction.

8. The spark plug according to any one of claims 1 to 7, wherein firing surface forming portions of at least one of said center electrode and ground electrode, which face to said spark discharge gap, comprises at least a metallic material containing totally 10 weight % or more of at least one of Fe, Cr and Cu.

9. The spark plug according to claim 8, wherein said metallic material comprises at least one of Ni and Fe as a main component.

10. The spark plug according to claim 1, wherein said center electrode is configured such that the top end of said center electrode is smaller than the base end of said center electrode.

11. The spark plug according to claim 1, wherein a terminal member is fixed to one end of said through hole axially formed in said insulating member, and said center electrode is fixed to the other end of said through hole, a resistor member is located between said terminal member and said center electrode within said through hole, and electric resistance of an electrical path including said resistor member between said terminal member and said center electrode is 2 kΩ or higher.

12. The spark plug according to claim 1, wherein a portion of at least one of said ground electrode and said center electrode, which includes part of said firing surfaces, is a wasting wearing portion comprising at least one of a metallic material containing at least one of Ir, Pt, Rh, W, Re and Ru and a composite material containing said metallic material as a main component.

13. The spark plug according to claim 1, wherein a wasting resistance portion, which comprises at least one of a metallic material containing at least one of Ir, Pt, Rh, W, Re and Ru and a composite material containing said metallic material as a main component, is formed on the outer circumferential surface of said center electrode while not extending over regions located on both sides of the top end position of said insulating member in the axial direction of said center electrode.

14. The spark plug according to claim 13, wherein on the assumption that a side of said spark plug which contains the top end surface of said center electrode in the axial direction is the front side, an edge of the front side of said wasting resistance portion is positioned within a section between a top end edge of said insulating member and a position where is 0.5 mm backward from the top end edge of said insulating member.

15. The spark plug according to claim 13, wherein a region around said wasting resistance portion where a total amount of Fe and Cr is 7 weight % or more is positioned within a section between a position where is 0.5 mm forward from the top end edge of said insulating member and a position where is 0.3 mm backward from the top end edge of said insulating member in the axial direction of said insulating member.

16. The spark plug according to claim 1, wherein two or more ground electrodes are arranged surrounding said center electrode.

17. The spark plug according to claim 1, wherein the base end of said ground electrode is joined to said main metallic shell, while the top end of said ground electrode is bent toward said center electrode so that the top end surface opposes to the side surface of the top end of said center electrode to form first gap, the side surface of the top end of said ground electrode oppose to the top end surface of said insulating member to form second gaps smaller than said first gap; and further wherein (h) is adjusted to be 0.3 mm or longer where "h" is a distance between rear-side edge of the end surface of said ground electrode in the axial direction of said center electrode and the top end surface of said insulating member on the assumption that the side of the top end surface of said center electrode in the axial direction is the front side, and the end opposite to the former is the rear side.

18. The spark plug according to claim 1, wherein the end surfaces of the ground electrode sandwiches the top end portion of the insulating member; and wherein a ratio h/H is 0.5 or less where H is a distance from the rear-side edge of the end surface of said ground electrode in the axial direction of said center electrode, to the front-side edge of said ground electrode, and (h) is a distance from the front end surface of said insulating member to the front-side edge of the end surface of said ground electrode.

19. The spark plug according to claim 1, wherein an axial cross section diameter of the top end of the center electrode is 2.0 mm or more.

20. The spark plug according to claim 17, wherein an additional ground electrode is arranged so that side surface is opposed to the top end surface of said center electrode.

* * * * *